US007825886B2

(12) United States Patent
Park

(10) Patent No.: US 7,825,886 B2
(45) Date of Patent: Nov. 2, 2010

(54) LIQUID CRYSTAL DISPLAY DEVICE DRIVEN WITH A SMALL NUMBER OF DATA LINES

(75) Inventor: Joon-Kyu Park, Gyeonggi-Do (KR)

(73) Assignee: LG Display Co., Ltd., Seoul (KR)

( * ) Notice: Subject to any disclaimer, the term of this patent is extended or adjusted under 35 U.S.C. 154(b) by 984 days.

(21) Appl. No.: 11/128,169

(22) Filed: May 13, 2005

(65) Prior Publication Data

US 2006/0139281 A1 Jun. 29, 2006

(30) Foreign Application Priority Data

Dec. 29, 2004 (KR) ..... 10-2004-0115626

(51) Int. Cl.
*G09G 3/36* (2006.01)

(52) U.S. Cl. ..... 345/96; 345/92

(58) Field of Classification Search ..... 345/204–215, 345/690–699, 87–111; 315/169.1–169.3
See application file for complete search history.

(56) References Cited

U.S. PATENT DOCUMENTS 5,394,171 A * 2/1995 Rabii ..... 345/213
6,075,505 A * 6/2000 Shiba et al. ..... 345/87
6,476,785 B1 * 11/2002 Pathak et al. ..... 345/90
7,081,876 B2 * 7/2006 Ryuh ..... 345/96
2001/0048106 A1 * 12/2001 Tanada ..... 257/66
2002/0084960 A1 * 7/2002 Song et al. ..... 345/87
2003/0080932 A1 * 5/2003 Konno et al. ..... 345/96
2003/0090451 A1 * 5/2003 Ahn ..... 345/96
2003/0189537 A1 * 10/2003 Yun ..... 345/87
2004/0021677 A1 * 2/2004 Sasaki et al. ..... 345/694
2005/0024317 A1 * 2/2005 Sano ..... 345/100
2005/0134781 A1 * 6/2005 Kim ..... 349/139

* cited by examiner

*Primary Examiner*—Chanh Nguyen
*Assistant Examiner*—Long Pham
(74) *Attorney, Agent, or Firm*—Birch, Stewart Kolasch & Birch LLP

(57) ABSTRACT

A liquid crystal display device includes a timing control unit for generating first and second control signals, which are transitioned every ½ frame. A polarity signal is set according to a count number obtained by counting the number of wave forms of the first and/or second control signals. A plurality of gate lines and data lines are arranged on a substrate crossing each other. A plurality of pixels are arranged in a matrix format on the substrate, with two pixels being provided in the regions divided by the gate and data lines. A data driving unit determines polarities of the first and second image data according to the polarity signal being received from the timing control unit, and then supplies the first and second image data to the pixels in the first and second columns through the first and second data lines, respectively.

21 Claims, 7 Drawing Sheets

| COUNT NUMBER | INITIAL VALUE OF POLARITY SIGNAL |
|---|---|
| 0 | 1(0) |
| 1 | 0(1) |
| 2 | 0(1) |
| 3 | 1(0) |

LIQUID CRYSTAL DISPLAY DEVICE DRIVEN WITH A SMALL NUMBER OF DATA LINES

This application claims the benefit of the Korean Application No. 10-2004-0115626 filed on Dec. 29, 2004, which is hereby incorporated by reference.

BACKGROUND OF THE INVENTION

1. Field of the Invention

The present invention relates to an LCD device, and more particularly, to an LCD device which is driven with a small number of data lines in comparison with the background art. The present invention also relates to a 2-dot inversion method of driving an LCD device, thereby preventing deterioration in image quality caused by a specific pattern.

2. Description of the Background Art

Display devices as visual information transfer media have gained more importance in an information oriented society. Among them, liquid crystal display (LCD) devices have rapidly replaced traditional cathode ray tubes (CRT) devices as the next-generation of display devices because superior legibility, low power consumption and high definition.

An LCD device includes an LCD panel for displaying an image, a driving unit for driving the LCD panel, and a back-light unit for supplying light to the LCD panel.

Liquid crystals used in the LCD device are not light emitting materials, which emit light by themselves, but rather are light receiving materials, which pass light from the outside by various transmittance to allow an image to be displayed on a screen. Accordingly, a back-light unit, e.g. a separate light source, is provided in the LCD device.

FIG.1 illustrates an LCD device in accordance with the background art. As shown in FIG. 1, the LCD device includes: a plurality of data lines (DL1~DL4) vertically disposed on a substrate; a plurality of gate lines (GL1~GL4) horizontally disposed on the substrate; and a plurality of pixels (R, G and B) divided according to the data lines (DL1~DL4) and the gate lines (GL1~GL4), perpendicularly crossing each other.

The pixels (R, G and B) are disposed in a matrix format on the substrate, in which a red pixel (R), a green pixel (G) and a blue pixel (B) are repetitively disposed. Switching devices (SW1) such as thin film transistors (TFTs) are individually provided at the pixels (R, G and B). The pixels in a column are connected with a corresponding data line (DL1~DL4) by respective switching devices (SW1). The pixels in a row are connected with a corresponding gate line (GL1~GL4) by respective switching devices (SW1). More specifically, gate electrodes of the switching devices (SW1) connect with the gate lines (GL1~GL4), and source electrodes of the switching devices (SW1) connect with the data lines (DL1~DL4), and drain electrodes of the switching devices (SW1) connect with pixel electrodes 10.

Common electrode lines (CL1~CL3), in parallel with the gate lines (GL1~GL4), are individually disposed on the substrate. The common electrode lines (CL1~CL3) partially overlap the pixel electrodes 10, provided at the respective pixels (R, G and B). Common electrodes are provided at parts of the common electrode lines (CL1~CL3) overlapping the pixel electrodes 10, and a common voltage is supplied through the common electrode lines (CL1~CL3). An electric field caused by a voltage differential is formed between the pixel electrode 10 and the common electrode.

As scan signals are sequentially supplied to the gate lines (GL1~GL4) from a gate driving unit in the LCD device, the switching devices (SW1) connected to the corresponding supplied gate line (GL1~GL4) are all turned on. In addition, image data, outputted from a data driving unit and transmitted through the corresponding data lines (DL1~DL4) during a period when the switching devices (SW1) are turned on, is supplied to the pixels (R, G and B) through the switching devices (SW1). The image data supplied to the pixels (R, G and B) is applied to the pixel electrodes 10.

Each common electrode corresponding to each pixel (R, G and B) receives a common voltage through the common voltage lines (CL1~CL3). When the voltage is supplied to the pixel electrode (10) and the common electrode as described, an electrode field caused by a voltage differential is formed between the pixel electrode and the common electrode to thereby rearrange liquid crystals of the corresponding pixels (R, G and B) and control light transmittance, whereby an image having desired luminance is implemented at the pixels (R, G and B).

When a certain electric field is continuously applied to a liquid crystal layer of the LCD device, liquid crystals are deteriorated and undesirable after-images are generated by a DC voltage component. Accordingly, in order to prevent deterioration in the liquid crystals and get rid of the DC voltage component, positive and negative voltages of image data are repeated and supplied on the basis of the common voltages. Such a driving method is referred to as an inversion method.

The inversion driving method can be classified into several types. In a frame inversion method, the polarity of image data is inverted by a unit of one frame of an image and supplied. In a line inversion method, the polarity of image data is inverted by units corresponding to gate lines and supplied. In a dot inversion method, the polarity of image data according to pixels adjacent to each other is inverted and supplied, and further the polarity of image data is inverted by a unit of one frame of an image and supplied. Among the several types of inversion driving methods, the dot inversion method performs well at preventing deterioration in image quality, and is the most widely used.

In the LCD device illustrated in FIG. 1, an image is implemented on a screen by the dot inversion method by supplying image data having different polarities through every odd numbered data line (DL1, DL3, . . . ) and every even numbered data line (DL2, DL4, . . . ) of the data lines (DL1~DL4). When the image data, having polarities opposite to each other, is supplied to adjacent pixels according to the smallest unit comprising a red pixel (R), a green pixel (G) or a blue pixel (B), the method is referred to as a 1-dot inversion method. Compared to the line inversion method or the frame inversion method, the 1-dot inversion method produces less deterioration in image quality. However, the 1-dot inversion method still experiences some deterioration in image quality, such as deterioration due to crosstalk. In particular, serious deterioration in image quality can be caused in an image where a specific pattern repetitively appears, as shown in FIG. 2A or FIG. 2B.

FIG. 2A is a diagram illustrating one example of polarities of pixels arranged on a screen and FIG. 2B is a diagram illustrating another example of polarities of pixels arranged on the screen, in accordance with the background art. The 1-dot inversion method is used in the screens of FIGS. 2A and 2B, in which specific patterns in black and white are shown. FIG. 2A illustrates a screen in which a vertical pattern appears, and FIG. 2B illustrates a screen in which a checkerboard pattern appears. When the vertical pattern is implemented on the screen as shown in FIG. 2A, a specific pattern occurs regularly, whereby image data having one polarity is supplied to the pixels (P10) of a line unit.

A specific pattern is also shown in the checkerboard pattern of FIG. 2B. Image data having one polarity is applied to the pixels (P10) of a line unit. However, in FIG. 2A, the pixels (10) of the line unit alternately receive positive image data and negative image data, and in FIG. 2B, one of positive image data and negative image data is supplied to the entire pixels (P10).

As described above, one polarity is strongly applied to the pixels (P10) of a line unit, which may cause a voltage change in the common voltage lines corresponding to the pixels (P10) of the line unit. For example, when more positive image data is supplied to the pixels of the line unit than negative image data, a voltage level of the common voltage lines may increase in comparison to its original voltage level. When more negative image data is supplied thereto, a voltage level of the common voltage lines may decrease in comparison to its original voltage level. Such a voltage change changes the size of the electric field applied to the liquid crystals, causing horizontal crosstalk in which a horizontal stripe occurs on the screen.

As described above, in the LCD device, the pixels (R, G and B) of a line unit individually correspond to the gates lines (GL1~GL4), and the pixels (R, G and B) of a column unit individually correspond to the data lines (DL1~DL4), to receive scan signals and image data, respectively. In order to obtain high resolution in an LCD device, fabricated to have a large area and high resolution, the number of gate lines (GL1~GL4) and the number of data lines (DL1~DL4) should be increased. This increases fabrication costs.

SUMMARY OF THE INVENTION

Therefore, an object of the present invention is to provide an LCD device, which can be driven by a 2-dot inversion method to thereby prevent deterioration in image quality which can be generated in a 1-dot inversion method.

It is also an object of the present invention to provide an LCD device which can be driven in a manner identical to the background art with a decreased number of data lines in comparison to the background art to thereby reduce the fabrication costs.

To achieve these and other advantages and in accordance with the purpose of the present invention, as embodied and broadly described herein, there is provided an LCD device including:

a timing control unit for generating a first control signal and a second control signal which are transitioned every ½ frame, and setting a polarity signal according to the count number obtained by counting the number of wave forms of the first control signal and the second control signal; a plurality of gate lines arranged on a substrate in a first direction; a plurality of data lines arranged on the substrate in a second direction and crossing the gate lines; a plurality of pixels arranged in a matrix format on the substrate, two of the pixels being provided at every region divided by the gate lines and the data lines; and a data driving unit for determining polarities of first image data and second image data according to the polarity signal being received from the timing control unit, and then supplying the first image data to the pixels in the first column through the first data line and supplying the second image data to the pixels in the second column through the second data line.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 4A to 4D sequentially illustrate the polarities which are substantially implemented in the LCD device, in accordance with the present invention.

DETAILED DESCRIPTION OF THE PREFERRED EMBODIMENTS

Reference will now be made in detail to the preferred embodiments of the present invention, examples of which are illustrated in the accompanying drawings.

An LCD device to obtain the objects of the present invention includes: a timing control unit for generating a first control signal and a second control signal which are transitioned every ½ frame, and setting a polarity signal according to the count number obtained by counting the number of rising edges or falling edges of the first and second control signals; a plurality of gate lines arranged on a substrate in a horizontal direction; a plurality of data lines arranged on the substrate in a longitudinal direction and crossing the gate lines; a plurality of pixels arranged in a matrix format on the substrate, two of the pixels being provided at every region divided by the gate lines and the data lines; and a data driving unit for determining polarities of first image data and second image data according to the polarity signal being received from the timing control unit, and then supplying the first image data to the pixels in the first set or column of pixels through the first data line and supplying the second image data to the pixels in the set or second column of pixels through the second data line.

Figure 1:
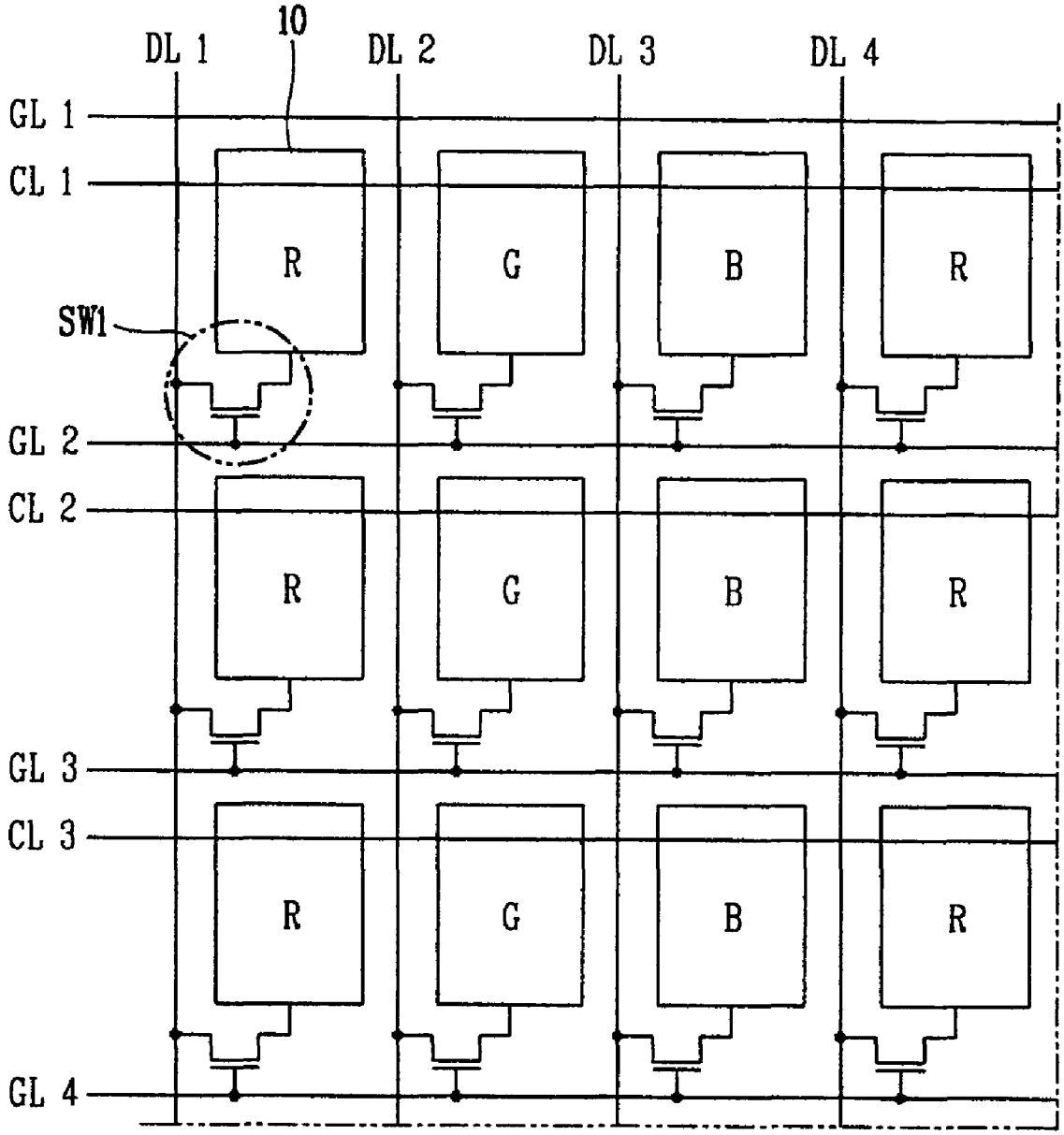
FIG. 1 BACKGROUND ART
FIG. 1 illustrates an LCD device, in accordance with the background art.
Figure 2A:
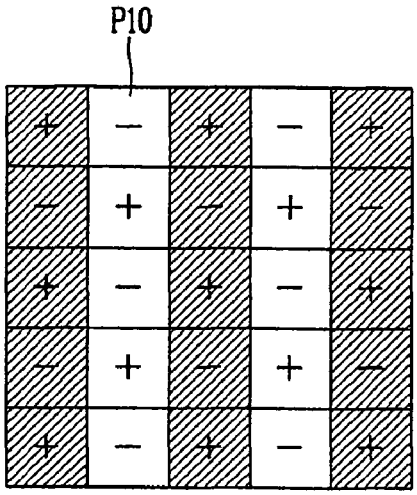
FIG. 2A BACKGROUND ART
FIG. 2A is a diagram illustrating one example of polarities of pixels arranged on a screen, in accordance with the background art.
Figure 2B:
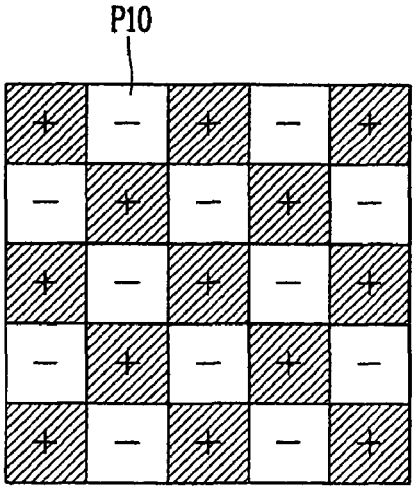
FIG. 2B BACKGROUND ART
FIG. 2B is a diagram illustrating another example of polarities of pixels arranged on the screen, in accordance with the background art.
Figure 3A:
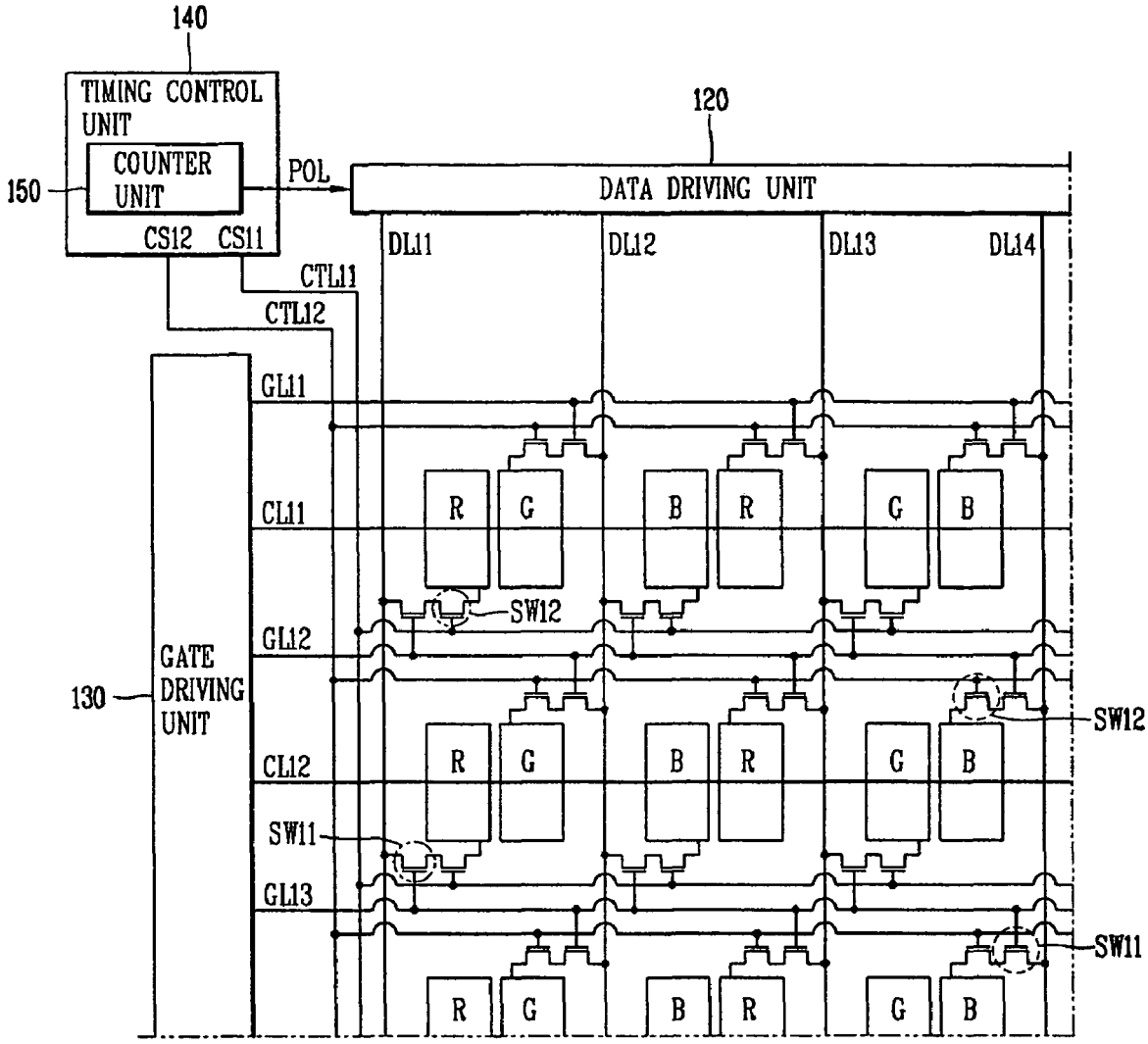
FIG. 3A is a diagram illustrating an LCD device, in accordance with the present invention.
Figures 3B, 3C:
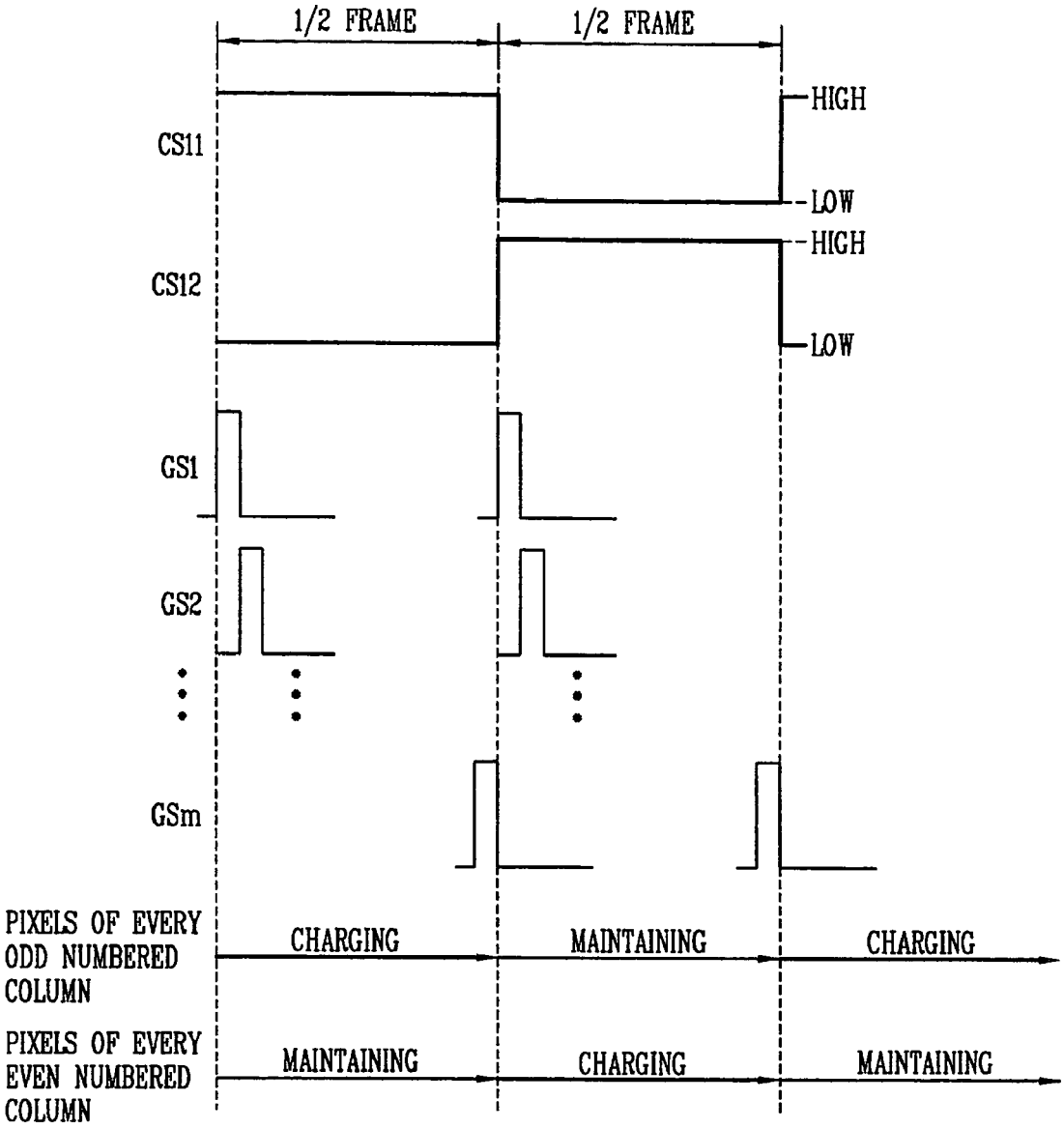
FIG. 3B is a timing diagram illustrating a wave form when the LCD device of FIG. 3A is driven.
FIG. 3C is a table showing the count number of a counter unit provided in FIG. 3A and an initial value of a polarity signal determined according to the count number.

FIG. 3A is a diagram illustrating an LCD device in accordance with the present invention, FIG. 3B is a timing diagram illustrating a wave form when the LCD device of FIG. 3A is driven, and FIG. 3C is a table showing the count number of a counter unit provided in FIG. 3A and an initial value of a polarity signal determined according to the count number.

As shown herein, the LCD device includes: a plurality of gate lines (GL11~GL13) arranged on a substrate in a horizontal direction; a plurality of data lines (DL11~DL14) arranged on the substrate in a vertical direction and crossing the gate lines (GL11~GL13); a plurality of pixels (R, G and B), two of the pixels being provided at every region divided by the gate lines (GL11~GL13) and the data lines (DL11~DL14); first and second control signal lines (CTL11 and CTL12) in parallel with the gate lines (GL11~GL13) arranged on the substrate; first switching devices (SW11) provided at the respective pixels (R, G and B) and receiving image data by being turned on by scan signals upon electrically connecting with the gate lines (GL11~GL13) and the data lines (DL11~DL14); and second switching devices (SW12) connecting with the first switching devices (SW11) and supplying image data supplied through the first switching devices (SW11) to the pixels (R, G and B) by being turned on by a first control signal (CS11) or a second control signal (CS12).

The pixels (R, G and B) include red (R), green (G) and blue (B). The pixels (R, G and B) of the red (R), green (G) and blue (B) are arranged in a matrix format on the substrate.

The gate lines (GL11~GL13) and the data lines (DL11~DL14) perpendicularly cross each other on the substrate, dividing a plurality of regions. Two of the pixels (R, G or B) are defined in the regions. As illustrated in the drawings, the pixels (R, G and B) of a column unit are connected with the data lines (DL11~DL14) at both sides of the column unit through the second switching devices (SW12). That is, image data can be supplied to two columns of the pixels (R, G and B) through each data line (DL11-DL14). Thus, the LCD device can be driven with only half of the data lines (DL11~DL14), as compared to the background art to thereby decrease a circuit area of the driving unit. Thus, fabrication costs of the LCD device can be reduced.

The first control signal line (CTL11) and the second control signal line (CTL12), in parallel with the gate lines (GL11—GL13), are arranged on the substrate in the horizontal direction. The first control signal line (CTL11) and the second control signal line (CTL12) connect with gate electrodes of the second switching devices (SW12).

The source electrodes of the second switching devices (SW12) are connected with the drain electrodes of the first switching devices (SW11). Therefore, even if the first switching devices (SW11) are turned on and receive image data through the source electrodes, the image data cannot be transmitted to the pixel electrodes (not shown) provided at the pixels (R, G and B), unless the second switching devices (SW12) are also turned on. In order for image data to be supplied to the pixel electrodes, both the first switching devices (SW11) and the second switching devices (SW12) must be turned on. Thin film transistors (TFTs) can be used as the first switching devices (SW11) and the second switching devices (SW12).

The data driving unit 120 for supplying image data to the respective pixels (R, G and B) through the data lines (DL11~DL14) supplies image data to the data lines (DL11~DL13) by a 1-dot inversion method. In addition, the first and second control signals (CS11 and CS12) supplied to the second switching devices (SW12), respectively, through the first and second control signal lines (CTL11 and CTL12) from the timing control unit 140 are transitioned to different potentials (e.g. a low potential or voltage or a high potential or voltage) by a unit of a ½ frame.

As shown in FIG. 3B, during a period (e.g. frame) that the first control signal (CS11) or the second control signal (CS12) has a high potential supplied to the pixels (R, G and B), scan signals are sequentially supplied to the gate lines (GL11~GL13) to thereby turn on the first switching devices (SW11) of the pixels (R, G and B) connected with the corresponding gate lines (GL11~GL13). When the first control signal (CS11) is in a state of high potential, the second switching devices (SW12) connected with the pixels (R, G and B) of every odd numbered column are turned on. Thus, image data is supplied to the pixels (R, G and B) of every odd numbered column such that the pixels (R, G and B) are charged with a voltage to create image data. When the first control signal (CS11) is in a state of low potential and the second control signal (CS12) is changed into a state of high potential, the second switching devices (SW12) connected with the pixels (R, G and B) of every even numbered column are turned on and the second switching devices (SW12) connected with the pixels (R, G and B) of every odd numbered column are turned off. Thus, the pixels (R, G and B) of every even numbered column may be charged with a voltage to create image data.

In addition, for the same period, the voltage of the image data charged to the pixels (R, G and B) of every odd numbered column is maintained. Though not illustrated in the drawings, the pixels (R, G and B) are individually provided with storage capacitors, by which the pixels (R, G and B) remain charged with image data. The charged status of the pixels (R, G and B) is maintained for one frame by the charging voltage of the image data supplied by the data lines (DL11~DL14).

As described above, the data driving unit 120 alternately drives the pixels (R, G and B) of every odd numbered column and the pixels (R, G and B) of every even numbered column by the first control signal (CS11) and the second control signal (CS12), respectively. The polarities of the first control signal (CS11) and the second control signal (CS12) are inverted every ½ frame. In addition, the scan signal is supplied twice to each gate line (GL11~GL13) during one frame.

The timing control unit 140 outputs the first control signal (CS11) and the second control signal (CS12) with the polarities inverted by a unit of a ½ frame. Thus, the first control signal (CS11) and the second control signal (CS12) have different potentials from each other at any given time. If the first control signal (CS11) is at a high potential, the second control signal (CS12) is at a low potential. Likewise, if the second control signal (CS12) is at a high potential, the first control signal (CS11) is at a low potential.

The timing control unit 140 is provided with a counter unit 150 for counting the number of rising edges or falling edges of pulses of the first control signal (CS11) and the second control signal (CS12), which are transitioned to a high potential or a low potential every ½ frame. One cycle of the counter unit 150 is defined as a count to four. Since the counter unit 150 performs counts twice for one frame, because the first control signal (CS11) and the second control signal (CS12) are transitioned to a different potential every ½ frame, one cycle of the counter unit 150 equals two frames.

Each time the count number is changed, the counter unit 150 outputs a polarity signal (POL) corresponding to the changed count number. The outputted polarity signal (POL) is inputted to the data driving unit 120.

The data driving unit 120 determines the initial polarities of image data to be supplied to the pixels (R, G and B) through the data lines (DL11~DL13), according to the inputted polarity signal (POL). For example, when the polarity signal (POL) has a high potential, image data outputted at an initial stage corresponds to the data lines such that positive image data and negative image data can be outputted in a sequential and repetitive manner. When the polarity signal (POL) has a low potential, image data outputted at an initial stage corresponds to the data lines such that negative image data and positive image data can be outputted in a sequential and repetitive manner. That is, the polarity signal (POL) outputted from the timing control unit 140, by corresponding to the count number of the counter unit 150, determines the polarities of image data outputted from the data driving unit 120.

Of course, the function of the counter 150 could be moved to the data driving unit 120, in which case the first control signal (CS11) and the second control signal (CS12) would be sent to the data driving unit 120, which would internally monitor and count the number of rising or falling edges and adjust the polarity of the image data accordingly.

In FIG. 3C, an initial value of a polarity signal corresponding to the count number of the counter unit 150 is shown. As described above, the counter unit 150 counts the number of rising edges or falling edges of the first control signal (CS11) and the second control signal (CS12) and outputs a polarity signal (POL) corresponding to the count number. As shown in the table of FIG. 3C, when the count number is '0', an initial value of the polarity signal (POL) is determined as '1' and outputted. When the count number increases to '1', the initial value of the polarity signal (POL) is determined as '0'. And, when the count number increases to '2', the initial value of the polarity signal (POL) is maintained as '0' again. Finally, when the count number increases to '3', the initial value of the polarity signal (POL) is set as '1' again.

Here, the count number has a range of 0 to 3. When the count exceeds 3, the counter unit 150 begins counting from '0' again. The count number '0' is a value which is initially set when the LCD device is turned on.

As the count number increases from 0 to 3, initial values of the polarity signal (POL) are repetitively set as '1', '0', '0', '1' or '0', '1', '1', '0'. The initial values of the polarity signal are not set in the order that '0' and '1' are repeated, but the same initial values come out at the count numbers '0' and '3', so that the pixels (R, G and B) can be driven by a 2-dot inversion method, according to image data outputted by the polarity signal (POL). In this manner, deterioration in image quality, such as horizontal cross talk can be prevented in an image where a specific pattern occurs repetitively.

In view of initial values of the polarity signal (POL), the consecutive count numbers '3' and '0' are set to have identical initial values of the polarity signal (POL) and the consecutive count numbers '1' and '2' are set to have identical initial values of the polarity signal (POL). That is, identical initial values of the polarity signal (POL) are reset by a unit of two count numbers.

An operation of the LCD device will now be described. First, when a scan signal is supplied to the first gate line (GL11) from the gate driving unit 130, the first switching devices (SW11) connected with the first gate line (GL11) are all turned on. If the first control signal (CS11), outputted through the first control signal line (CTL11) from the timing control unit 140, has a low potential and the second control signal line (CTL12), outputted through the second control signal (CS12) from the timing control unit 140, has a high potential, image data outputted from the data driving unit 120 is supplied to the pixels (R, G and B) of every even numbered column because the second switching devices (SW12) are turned on by the second control signal (CS12) in a state when the first switching devices (SW11) provided at the pixels (R, G and B) of every even numbered column are being sequentially turned on by the gate lines (GL11-GL13).

Since the data driving unit 120 outputs image data by a unit of a ½ frame, according to the dot inversion method, image data having polarities different (e.g. opposite) from each other is transmitted through every odd numbered data line (DL11 and DL13) and every even numbered data line (DL12 and DL14). If the polarity signal (POL), outputted from the timing control unit 140, is '1' (e.g. a high potential voltage), the data driving unit 120 sequentially outputs positive image data and negative image data through every odd numbered data line (DL11 and DL13) and every even numbered data lines (DL12 and DL14), according to the polarity signal (POL). At this time, since only the second switching devices (SW12) provided at the pixels (R, G and B) of every even numbered column are turned on by the second control signal (CS12), negative information is supplied to the pixels (R, G and B) of every even numbered column through every even numbered data line (DL12 and DL14). The pixels (R, G and B) of every even numbered column are charged with and store a voltage of negative image data by storage capacitors (not shown) until the next image data is supplied.

When a scan signal is supplied to the second gate line (GL12) after one horizontal period passes, the first switching devices (SW11) of the pixels (R, G and B) of every odd numbered column and the pixels (R, G and B) of every even numbered column which are arranged at upper and lower portions of the second gate line (GL12) are all turned-on. However, since the driving state is still in a state of the first ½ frame, the first control signal (CS11) maintains its low potential state and the second control signal (CS12) maintains its high potential state, only the pixels (R, G and B) of every even numbered column are turned on by the second control signal (CS12) having a high potential. Accordingly, positive image data, wherein polarity is inverted according to passage of one horizontal period, is supplied to the pixels (R, G and B) of every even numbered column through every even numbered data line (DL12 and DL14). When such a driving method is repetitively performed, polarities of image data are displayed on the pixels (R, G and B) of every even numbered column according to the dot-inversion method. The pixels (R, G and B) of every even numbered column adjacent to one another are charged with image data having polarities different from each other.

As described above, when the ½ frame finishes by sequentially supplying scan signals to the respective gate lines (GL11~GL13), the second ½ frame starts. In the second ½ frame, the first control signal (CS11) is transitioned to a high potential and the second control signal (CS12) is transitioned to a low potential. Thus, the counter unit 150, in which the count number increases in synchronization with rising edges or falling edges of the first or second control signals (CS11 or CS 12), operates to increase the count number by one. At this time, a polarity signal (POL) is set as '0' (e.g. a low potential voltage) according to this count number and then supplied to the data driving unit 120.

As a new ½ frame starts, the gate driving unit 130 sequentially supplies scan signals to the gate lines (GL11~GL13) again. When the scan signal is supplied to the first gate line (GL11), the first switching devices (SW11) provided at the pixels (R, G and B) of every even numbered column connected with the first gate line (GL11) are turned on. However, since the pixels (R, G and B) of every even numbered column are connected with the second control signal line (CTL12), through the second switching devices (SW12), they maintain a state of being turned off by the second control signal (CS12) having a low potential.

If a scan signal is supplied to the second gate line (GL12), the first switching devices (SW11) provided at the pixels (R, G and B) of every odd numbered column and the pixels (R, G and B) of every even numbered column which are arranged at upper and lower portions of the second gate line (GL12) are turned on. However, only the pixels (R, G and B) of every odd numbered column are turned on by the first control signal (CS11). At this time, the data driving unit 120 sequentially outputs negative and positive image data through every odd numbered data line (DL11 and DL13) and every even numbered data line (DL12 and DL14) according to the inputted polarity signal (POL). Accordingly, the negative image data is supplied to the pixels (R, G and B) of every odd numbered column arranged above the second gate line (GL12) through the first and second switching devices (SW11 and SW12).

If the scan signal is supplied to the third gate line (GL13), positive image data is supplied to the pixels (R, G and B) of every odd numbered column of pixels (R,G and B) located above the third gate line (GL13) through every odd numbered data line (DL11 and DL13).

After a frame is completed, i.e. the first ½ frame and the second ½ frame passes, if a new ½ frame starts again, the first control signal (CS11) is transitioned to a low potential and the second control signal (CS11) is transitioned to a high potential again. At this time, the counter unit 150 increase the count number by one. That is, the count number becomes '2'. As shown in FIG. 3C, when the count number is '2', the polarity signal is maintained as '0'. However, since the first and second control signals (CS11 and CS12) have changed their transition states, the polarity of the image data displayed on the pixels (R, G and B) is different from the previous ½ frame.

When the scan signal is supplied to the first gate line (GL11), the first switching devices (SW11), connected to the corresponding gate line (GL11), are turned on, and only the second switching devices (SW12) of the pixels (R, G and B) of every odd numbered column connected with the second control signal line (CTL12) for supplying the second control signal (CS12) are turned on. Since the data driving unit 120 receives a polarity signal '0' identical with that of the previous ½ frame, it outputs negative image data through every odd numbered data line (DL11 and DL13) and outputs positive image data through every even numbered data line (DL12 and DL14) for the first horizontal period, in the order of negative and positive image data which was set in the previous ½ frame.

Accordingly, positive image data is supplied to the pixels (R, G and B) of every even numbered column. The positive image data replaces the negative image data in the first pixels (R, G and B) of the pixels (R, G and B) of every even numbered column, which have stored the negative image data during the previous frame. Thus, the two pixels (R and G) divided by the first data line (DL11) and the second data line (DL12) store the negative image data during the previous frame and thus are implemented by a 2-dot inversion method. However, as positive image data is supplied to green pixels (G) through the second data line (DL12), the two pixels (R and G) have image data with polarities different from each other.

Positive image data has been stored in the blue pixels (B) of every odd numbered column connected to the second data line (DL12) for the previous frame. As a result, the pixels (R, G and B) continue to be driven by a 2-dot inversion method, but identical polarities are shifted by one column and displayed.

Figure 3D:
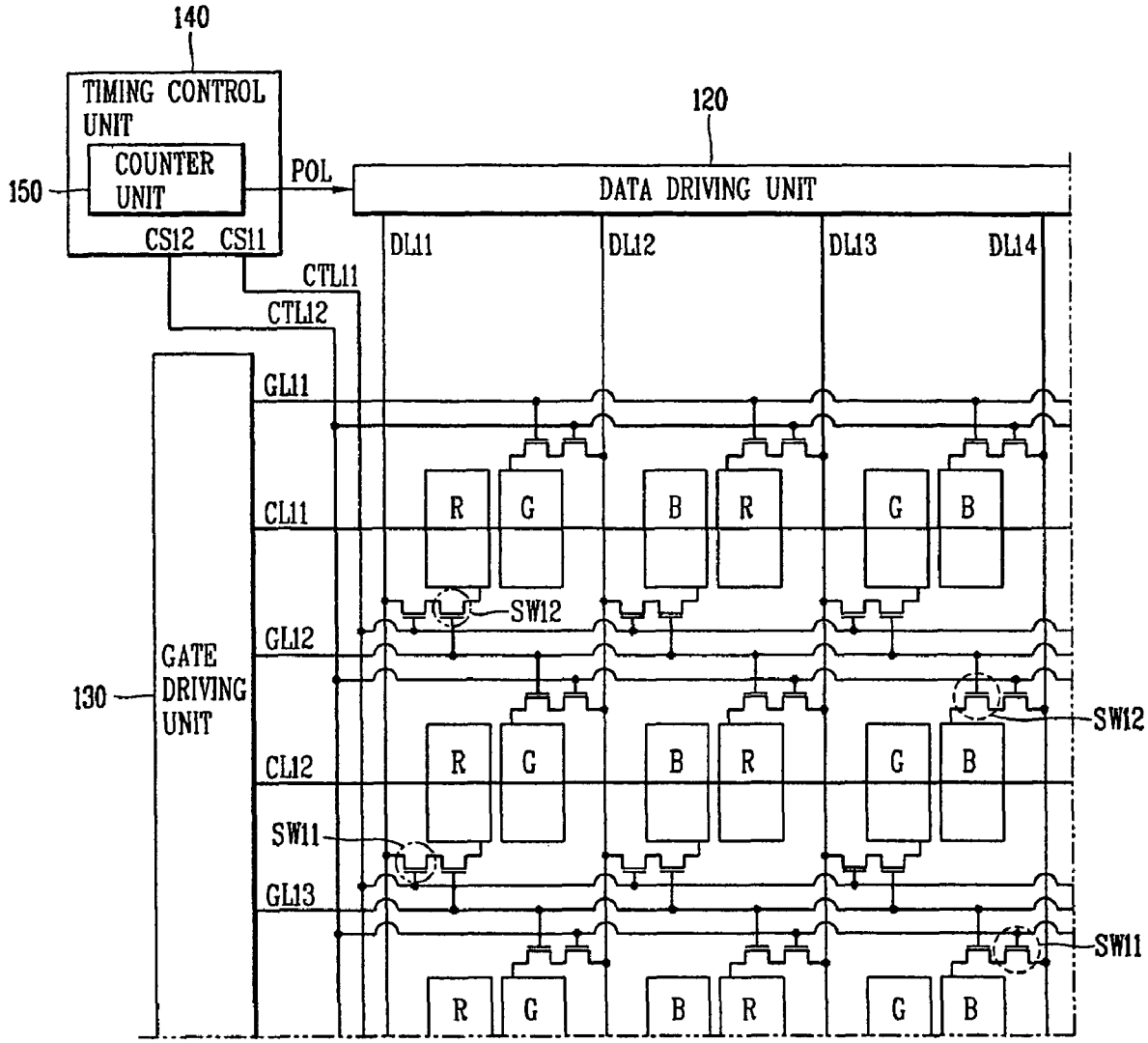
FIG. 3D is a diagram illustrating an LCD device, similar to FIG. 3A, but having alternate connection pattern for the first and second switching devices.

FIG. 3D is a diagram illustrating an LCD device, similar to FIG. 3A, but having an alternative connection pattern for the first and second switching devices. In FIG. 3D, each of the first switching devices (SW11) for receiving image data from the data driving unit 120 is turned on by the first control signal (CTL12) or the second control signal (CTL12). Also, each of the second switching devices (SW12) for receiving image data through an coupled first switching device (SW11) and for supplying the image data to an associated pixel is turned on by a scan signal supplied through one of the plurality of gate lines (GL11-GL13). The alternate embodiment of FIG. 3D would also drive the pixels (R, G and B) in accordance with a 2-dot inversion method, when the data driving unit 120 is operated in accordance with a 1-dot inversion method. The embodiment of FIG. 3D illustrates that the "turn on" electrical connections of first and second switching devices (SW11 and SW12) may be reversed.

As described above, the first and second control signals (CS11 and CS12) are transitioned every ½ frame, but the initial values of the polarity signal (POL) are changed every one frame in correspondence with the count number. Thus, the image data is supplied through the data driving unit 120 by the dot inversion method, but the 2-dot inversion method, in which polarities are continuously shifted left and right, can be substantially implemented in the pixels (R, G and B).

Figure 4A:
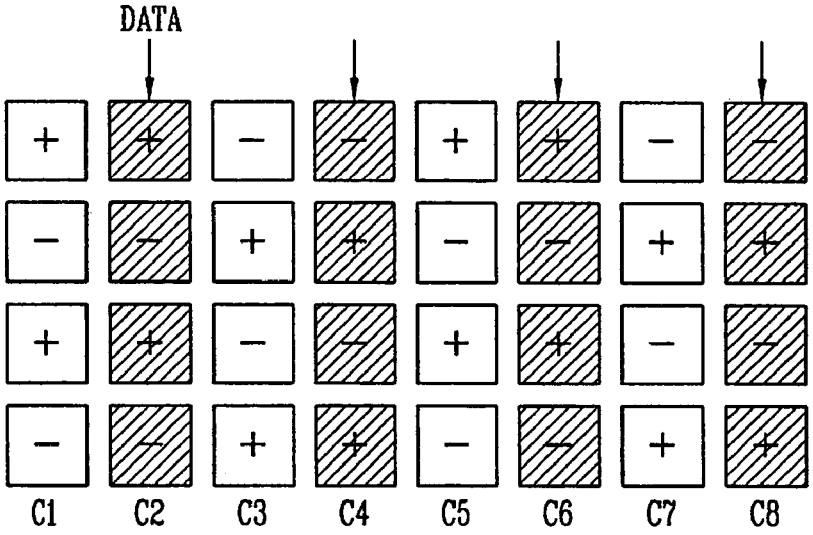
Figure 4B:
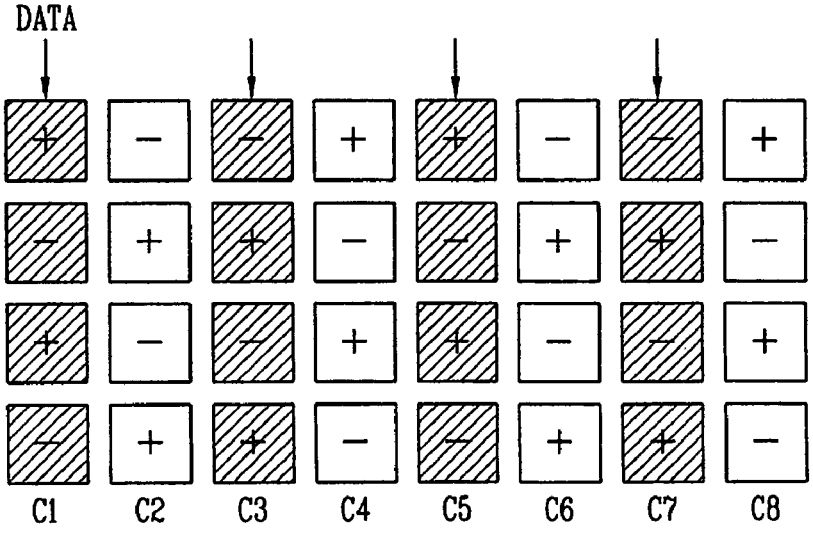

Such an operation is sequentially illustrated in FIGS. 4A to 4B. As shown in FIG. 4A, at an initial stage, the pixels of the first column (C1) and the pixels of the second column (C2) maintain image data having identical polarities in the first ½ frame of the first frame and are implemented by a 2-dot inversion method. Likewise, image data is maintained in the pixels of the third column (C3) and the pixels of the fourth column (C4), the pixels of the fifth column (C5) and the pixels of the sixth column (C6), and the pixels of the seventh column (C7) and the pixels of the eighth column (C8). When image data is supplied to the pixels of every even numbered column (C2, C4, C6 and C8) by a dot inversion method, the polarities change, as illustrated in FIG. 4B, in the second ½ frame of the first frame. That is, the polarities of the image data supplied to the pixels of the first column (C1) and the pixels of the second column (C2), which maintained the image data having polarities identical to each other, now become different from each other. However, the polarities of image data supplied to the pixels of the second column (C2) and the pixels of the third column (C3) become the same, such that the positions of the polarities have shifted by one pixel but the overall pixels are still formed by a 2-dot inversion method.

Figure 4C:
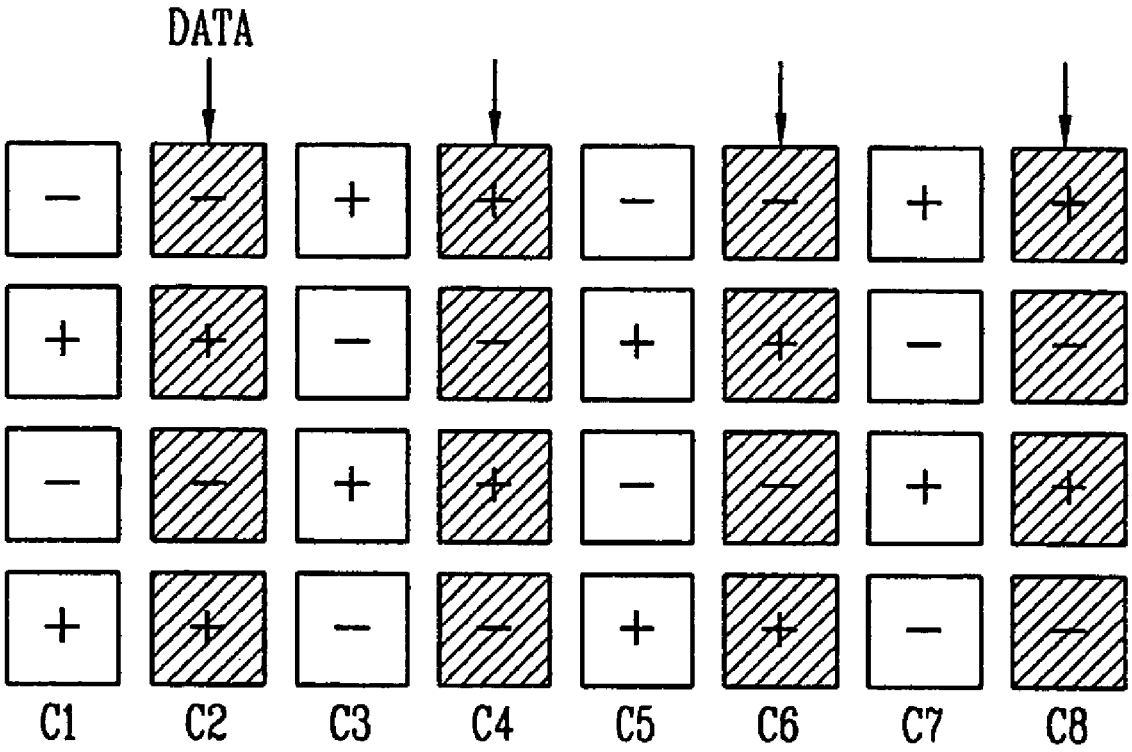

When image data is supplied to the pixels of every odd numbered column (C1, C3, C5 and C7) in the second ½ frame of the first frame by the dot inversion method, a polarity configuration is formed like the first ½ frame of the second frame illustrated in FIG. 4C. Like a change between the first ½ frame and the second ½ frame of the first frame, the polarities of the pixels of the second column (C2) and of the third column (C3), the pixels of the fourth column (C4) and of the fifth column (C5), and the pixels of the six column (C6) and of the seventh column (C7) have changed again. Like the first ½ frame of the first frame, the polarities of the pixels in the first column (C1) and second column (C2), the pixels of the third column (C3) and the fourth column (C4), the pixels of the fifth column (C5) and the six column (C6), and the pixels of the seventh column (C7) and the eight column (C8) become the same. However, a difference from the first ½ frame of the first frame is that the sign of the polarities have changed from plus "+" to minus "−".

When image data is supplied to every even numbered column (C2, C4, C6 and C8), again by the dot inversion method, the polarities of the data shift by one column, like the second ½ frame of the second frame, but an implementation of the 2-dot inversion type is maintained.

According to the above operation, the pixels arranged in a matrix format on the substrate are driven simultaneously at each cycle comprising two frames, and image data is supplied every ½ frame to the pixels of every odd numbered column and the pixels of the every even numbered column by the dot inversion method. The polarities of the respective pixels are continuously changed at each cycle comprising one frame to thereby prevent deterioration of the liquid crystals and the pixels are driven by the 2-dot inversion method to thereby reduce or prevent deterioration of an image quality.

As described so far, the LCD device, in accordance with the present invention, can reduce the circuit size of the data driving unit by driving pixels with a decreased number of data lines, as compared to the background art. This advantage reduces fabrication costs for the LCD device.

In addition, the present invention alternately supplies image data, in accordance with the dot inversion method, by dividing pixels into at least two sets, such as odd numbered columns and even numbered columns, with polarities of the respective pixels being changed every frame to thereby reduce or prevent deterioration in the liquid crystals. This driving method constitutes a 2-dot inversion method and reduces or prevents deterioration in image quality.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A liquid crystal display device comprising:

a timing control unit for generating a first control signal and a second control signal which are transitioned in state every ½ frame, the timing control unit having a counter unit for outputting a polarity signal according to a count number based on the occurrence of rising or falling edges of at least one of the first and second control signals and restarting to count after two frames;

a substrate;

a plurality of gate lines arranged on said substrate in a first direction;

a plurality of data lines arranged on said substrate in a second direction and crossing said plurality of gate lines to form a plurality of regions bordered by two gate lines and two data lines;

a plurality of pixels arranged on said substrate, two of said plurality of pixels being provided in each region of said plurality of regions, an odd numbered pixel of an odd numbered row is connected to an even numbered gate line and an even numbered pixel of the odd numbered row is connected to an odd numbered gate line, and odd numbered pixel of an even numbered row is connected to an odd numbered gate line and an even numbered pixel of the even numbered row is connected to an even numbered gate line; and a data driving unit for determining polarities of first image data and second image data according to the polarity signal received from said timing control unit, said data driving unit supplying the first image data to a first set of pixels of an odd numbered column through an odd numbered data line and supplying the second image data to a second set of pixels of an even numbered column through an even numbered data line, wherein each pixel is coupled to a first switching device for receiving image data from said data driving unit, and a second switching device for receiving image data through said first switching device and for supplying the image data to an associated pixel, wherein a first switching device of the odd numbered pixel of the odd numbered row and a first switching device of the even numbered pixel of the even numbered row include a gate electrode connected to the even numbered gate line, and a first switching device of the even numbered pixel of the odd numbered row and a first switching device of the odd numbered pixel of the even numbered row include a gate electrode connected to the odd numbered gate line, wherein said first switching device is turned on by a scan signal supplied through one of said plurality of gate lines, and said second switching device is turned on by the first control signal or the second control signal, and wherein a first control signal line receives the first control signal from said timing control unit and is connected to the pixels of the first set through said second switching device, and a second control signal line receives the second control signal from said timing control unit and is connected to the pixels of the second set through said second switching device.

2. The liquid crystal display device of claim 1, wherein said first switching device includes a source electrode connected to one of said plurality of data lines.

3. The liquid crystal display device of claim 2, wherein said second switching device includes a source electrode connected to a drain electrode of said first switching device and a drain electrode connected with a pixel electrode of the associated pixel.

4. The liquid crystal display device of claim 1, wherein the first control signal has a first or second state, and the second control signal has a first or second state.

5. The liquid crystal display device of claim 4, wherein the state of the first control signal is always opposite to the state of the second control signal.

6. The liquid crystal display device of claim 5, wherein the first state corresponds to a first voltage potential greater than a second voltage potential corresponding to the second state.

7. The liquid crystal display device of claim 1, wherein a first control signal line receives the first control signal from said timing control unit and is connected to the pixels of the first set through said second switching devices and a second control signal line receives the second control signal from said timing control unit and is connected to the pixels of the second set through said second switching devices.

8. The liquid crystal display device of claim 1, wherein image data is supplied to said plurality of pixels by said data driving unit using a 1-dot inversion method.

9. The liquid crystal display device of claim 8, wherein image data is displayed by said plurality of pixels in a 2-dot inversion manner.

10. The liquid crystal display device of claim 1, wherein image data is displayed by said plurality of pixels in a 2-dot inversion manner.

11. The liquid crystal display device of claim 1, wherein a polarity of the image data supplied to the respective pixels is changed at each frame, and the respective pixels alternately have polarities of image data identical with those of their right or left adjacent pixels every ½ frame.

12. The liquid crystal display device of claim 1, wherein the polarity of the image data in the pixels shifts by one column every ½ frame.

13. A liquid crystal display device comprising:

a timing control unit for generating a first control signal and a second control signal;

a substrate;

a plurality of gate lines arranged on said substrate in a first direction;

a plurality of data lines arranged on said substrate in a second direction and crossing said plurality of gate lines to form a plurality of regions bordered by two gate lines and two data lines;

a plurality of pixels arranged on said substrate, two of said plurality of pixels being provided in each region of said plurality of regions, an odd numbered pixel of an odd numbered row is connected to an even numbered gate line and an even numbered pixel of the odd numbered row is connected to an odd numbered gate line, and odd numbered pixel of an even numbered row is connected to an odd numbered gate line and an even numbered pixel of the even numbered row is connected to an even numbered gate line; and a data driving unit for determining polarities of first image data and second image data according to a count of transitions between states of at least one of the first control signal and the second control signal, said data driving unit supplying the first image data to a first set of pixels of an odd numbered column through an odd numbered data line and supplying the second image data to a second set of pixels of an even numbered column through an even numbered data line, wherein each pixel is coupled to a first switching device for receiving image data from said data driving unit, and a second switching device for receiving image data through said first switching device and for supplying the image data to an associated pixel, wherein a first switching device of the odd numbered pixel of the odd numbered row and a first switching device of the even numbered pixel of the even numbered row include a gate electrode connected to the even numbered gate line, and a first switching device of the even numbered pixel of the odd numbered row and a first switching device of the odd numbered pixel of the even numbered row include a gate electrode connected to the odd numbered gate line, wherein said first switching device is turned on by a scan signal supplied through one of said plurality of gate lines, and said second switching device is turned on by the first control signal or the second control signal, and wherein a first control line receives the first control signal from said timing control unit and is connected to the pixels of the first set through said second switching device, and a second control signal line receives the second control signal from said timing control unit and is connected to the pixels of the second set through said second switching device.

14. The liquid crystal display device of claim 13, wherein the first switching device is turned on by a scan signal supplied through one of said plurality of gate lines, and the second switching device turned on by the first control signal or the second control signal.

15. The liquid crystal display device of claim 14, wherein:

said first switching device includes a source electrode connected to one of said plurality of data lines;

said second switching device includes a source electrode connected to a drain electrode of said first switching device and a drain electrode connected with a pixel electrode of the associated pixel;

the first control signal has a first or second state, and the second control signal has a first or second state; and the state of the first control signal is always opposite to the state of the second control signal.

16. A method of driving a liquid crystal device comprising the steps of:

providing a timing control unit; a substrate; a plurality of gate lines arranged on the substrate in a first direction; a plurality of data lines arranged on the substrate in a second direction and crossing the plurality of gate lines to form a plurality of regions bordered by two gate lines and two data lines; a plurality of pixels arranged on the substrate, two of the plurality of pixels being provided in each region of the plurality of regions, an odd numbered pixel of an odd numbered row is connected to an even numbered gate line and an even numbered pixel of the odd numbered row is connected to an odd numbered gate line, and odd numbered pixel of an even numbered row is connected to an odd numbered gate line and an even numbered pixel of the even numbered row is connected to an even numbered gate line; a data driving unit; a first switching device coupled each pixel for receiving image data from the data driving unit; a second switching device coupled each pixel for receiving image data through the first switching device and for supplying the image data to an associated pixel; a first control signal line for receiving the first control signal from said timing control unit and being connected to the pixels of the first set through said first switching device; and a second control signal line for receiving the second control signal from said timing control unit and being connected to the pixels of the second set through said second switching device;

generating a first control signal and a second control signal in the timing control unit;

transitioning the first control signal between states every ½ frame;

transitioning the second control signal between states every ½ frame;

outputting a polarity signal according to a count number based on the occurrence of rising or falling edges of at least one of the first and second control signals;

determining polarities of first image data and second image data to be outputted by the data driving unit according to the polarity signal received from the timing control unit;

supplying, via the data driving unit, the first image data to a first set of pixels of an odd numbered column through an odd numbered data line and supplying the second image data to a second set of pixels of an even numbered column through an even numbered data line;

turning the first switching device on by a scan signal supplied through one of the plurality of gate lines; and turning the second switching device on by the first control signal or the second control signal.

17. The method of claim 16, wherein said supplying step includes operating the data driving unit using a 1-dot inversion method.

18. The method of claim 17, further comprising the step of:

displaying image data by said plurality of pixels using a 2-dot inversion method.

19. The method of claim 16, further comprising the step of displaying image data by said plurality of pixels using a 2-dot inversion method.

20. The method of claim 16 wherein, the first switching device is turned on by a scan signal supplied through one of said plurality of gate lines, and the second switching device turned on by the first control signal or the second control signal.

21. The method of claim 20, wherein the first switching device includes a source electrode connected to one of said plurality of data lines, and a gate electrode connected to one of said plurality of gate lines, and the second switching device includes a source electrode connected to a drain electrode of said first switching device and a drain electrode connected with a pixel electrode of the associated pixel.

* * * * *